United States Patent [19]

Bounds et al.

[11] 3,955,528

[45] May 11, 1976

[54] INDUSTRIAL MOP-TREATING MACHINE

[75] Inventors: Joseph W. Bounds; Lynn E. Goldstein; Franklin E. Willard, all of Dallas, Tex.

[73] Assignee: Texel Industries, Inc., Cleburne, Tex.

[22] Filed: Mar. 28, 1975

[21] Appl. No.: 562,963

[52] U.S. Cl. ..... 118/2; 118/326; 68/205 R

[51] Int. Cl.[2] ..... B05C 11/00

[58] Field of Search ..... 118/2, 8, 326, 315; 134/48, 52, 46, 64 R, 122 R, 131; 68/205

[56] References Cited

UNITED STATES PATENTS

| | | | |
|---|---|---|---|
| 2,390,195 | 12/1945 | Tascher | 118/2 UX |
| 3,090,350 | 5/1963 | Walters | 118/2 |
| 3,101,088 | 8/1963 | Gray | 68/205 |
| 3,104,986 | 9/1963 | Goman et al. | 118/2 |
| 3,155,538 | 11/1961 | Schneider et al. | 118/2 |
| 3,682,131 | 8/1972 | Algeri et al. | 118/8 |
| 3,687,102 | 8/1972 | Dunn | 118/2 |
| 3,698,213 | 10/1972 | Mann | 68/205 |
| 3,796,186 | 3/1974 | Bounds et al. | 118/7 |

*Primary Examiner*—Ronald Feldbaum
*Attorney, Agent, or Firm*—Stoll and Stoll

[57] ABSTRACT

A generally portable industrial mop treating machine which draws mop treating liquid directly from a shipping and storage container and sprays same upon mops which are driven through the machine. The spray means is actuated by the passing mops and becomes inoperative in their absence.

5 Claims, 13 Drawing Figures

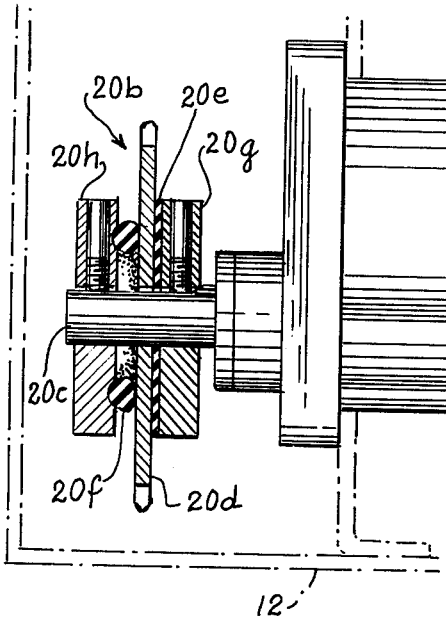
Fig. 7
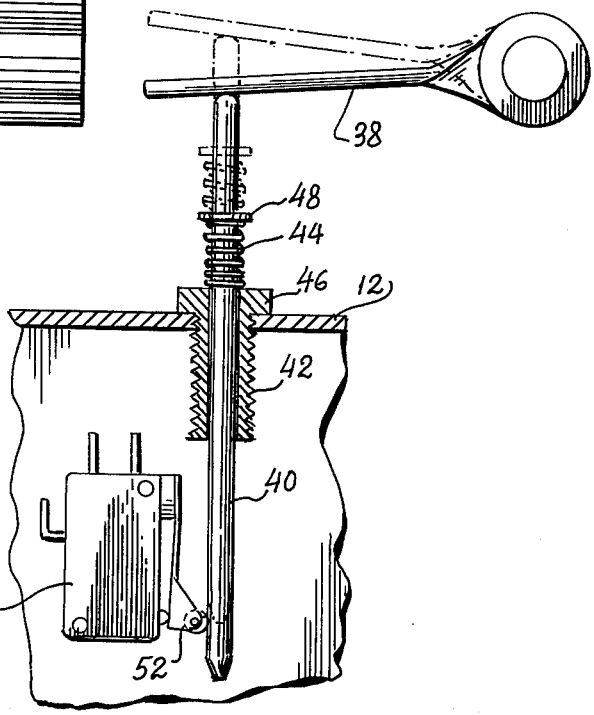
Fig. 8
Fig. 9
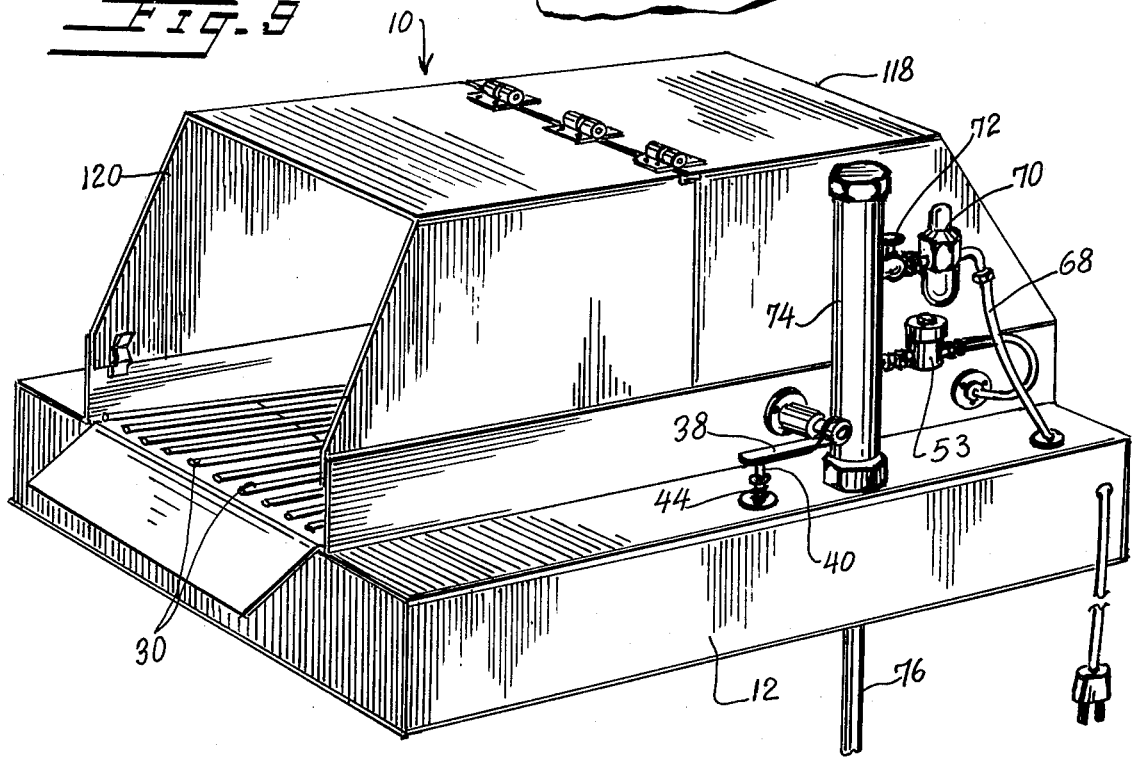

INDUSTRIAL MOP-TREATING MACHINE

BACKGROUND OF THE INVENTION

1. Field of Invention

This invention relates to industrial mops and to a method and means of treating same with oils and other mop-treating liquids.

2. Brief Description of the Prior Art

The closest prior patent art known to applicants is their own U.S. Pat. No. 3,796,186 which issued on Mar. 12, 1974. However this patent discloses a large machine, used in large industrial plants, for spraying large numbers of industrial mops which are carried through the machine by a conveyor. The spray continues as long as the conveyor moves, regardless of the presence or absence of mops thereon. This is not objectionable in large installations since the flow of mops through the machine is relatively continuous as long as the machine is in operation. It would be objectionable in smaller installations, as in hospitals, schools and other institutions, where only a relatively few mops are treated at any given time.

The patented machine also requires its own liquid reservoir (as distinguished from the shipping or storage container in which the liquid is received) and heating means for elevating the temperature of the liquid to the level of sprayable viscosity.

SUMMARY OF THE INVENTION

The present invention relates to a generally portable machine for treating industrial mops with oil and other liquid mop-treating materials. The machine is partly manually operated and partly automated. It is a manual machine in the sense that the mops are fed to it by hand; it is automated in the sense that a power mechanism seizes the mops after they are fed into the machine, automatically sprays them while they are moved through the machine, and then ejects them from the spray station. The spray mechanism automatically becomes operative when the mop driving mechanism of the machine engages a mop. The spray mechanism automatically shuts off when the mop driving mechanism discharges a mop.

More specifically, the mop driving mechanism consists of a pair of rollers, one power driven and the other an idler roller. One of these rollers, preferably the idler roller, is pivotally mounted for movement relative to the other (driven) roller and it is connected to a sensing means, for example, a solenoid switch. When a mop enters between the two rollers the pivotally mounted roller moves away from the driven roller and thereby activates the switch. This causes an opening of a valve in the fluid system thereby causing the mop to be sprayed while passing through the spray station. The moment the mop leaves the rollers, the pivotally mounted roller will move back to its original position against the driven roller and the switch will once again be activated but this time to close the valve in the fluid system. This of course, will stop the spraying operation.

It should be understood that the mechanism as above described is automatically adjustable to mops of different dimensions. Regardless of its dimensions, the entry of a mop between the two rollers will activate the spray mechanism and the spray will continue until the mop leaves the rollers. This is an important feature since mops are made in various sizes and the mechanism works equally well regardless of mop size.

Another adjustable feature of the present invention relates to the spray volume. The volume of the spray is adjusted by the simple expedient of regulating the pressure of the compressed air which ejects the mop-treating liquid through the spray heads. The spray heads may themselves be raised or lowered and they may be conventionally adjusted to adjust the spray form.

An important aspect of the present invention resides in the fact that the machine is relatively portable, in the sense that it may be carried from place to place by two individuals. It requires no support of its own in the form of a base of any kind. Instead, it is mounted directly on a container which contains the mop-treating liquid, for example, a 55 gallon drum. A hose extends from the machine into the drum and serves as the outlet therefrom. The machine is provided with a sink-type drain which receives waste spray and drippings and a drain pipe is provided to return the waste or unused liquid back to the drum.

The machine uses a conventional source of compressed air, e.g., a compressor. The compressed air forces the liquid out of the drum and ejects it onto the mops through a spray head. This may be done by means of an air operated reciprocating positive displacement pump or any other conventional liquid pumping means.

As will be understood when the contents of a given drum are consumed, the machine is simply removed from the exhausted drum and placed upon a fresh drum where it is ready to resume its function.

DESCRIPTION OF DRAWING

FIG. 7 is an enlarged view, partly in section, showing the motor drive mechanism.

FIG. 8 is an enlarged view, partly in section, showing the switch control mechanism.

FIG. 9 is a perspective view of the machine, including its hinged hood sections.

DESCRIPTION OF PREFERRED EMBODIMENT OF INVENTION

Figure 1:
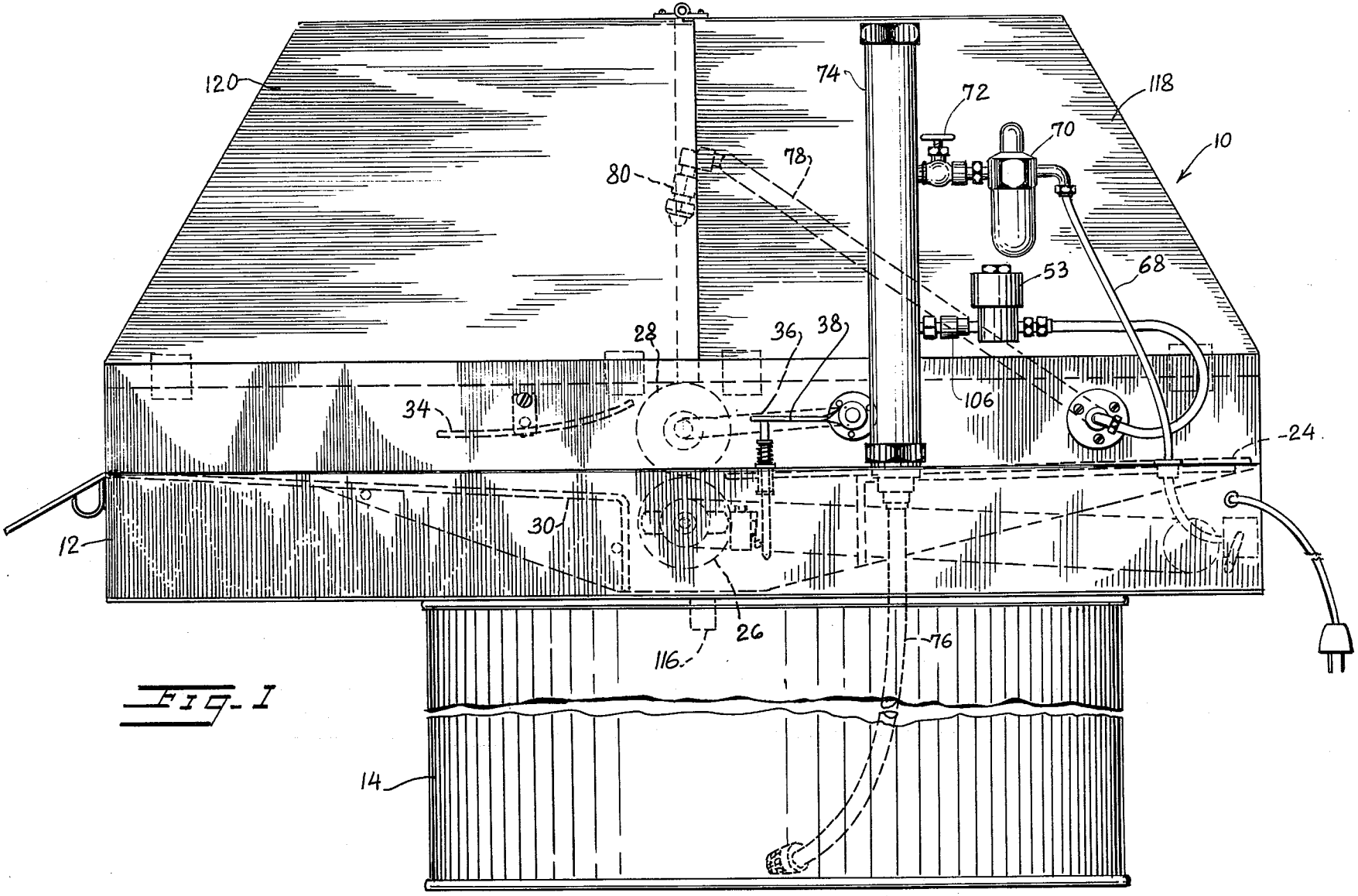
FIG. 1 is a side view of a mop-treating machine made in accordance with the principles of this invention.
Figure 2:
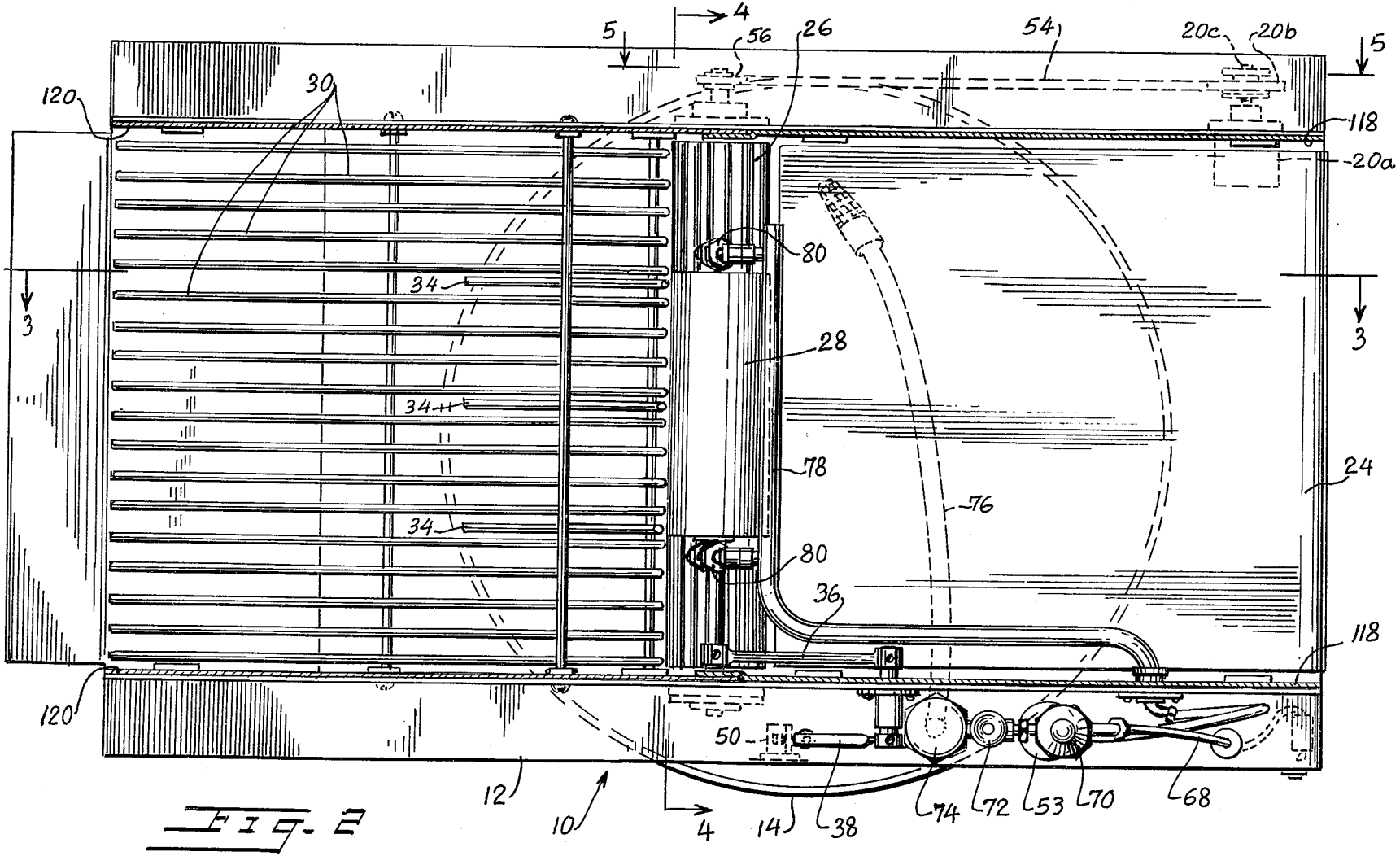
FIG. 2 is a top view thereof.
Figure 3:
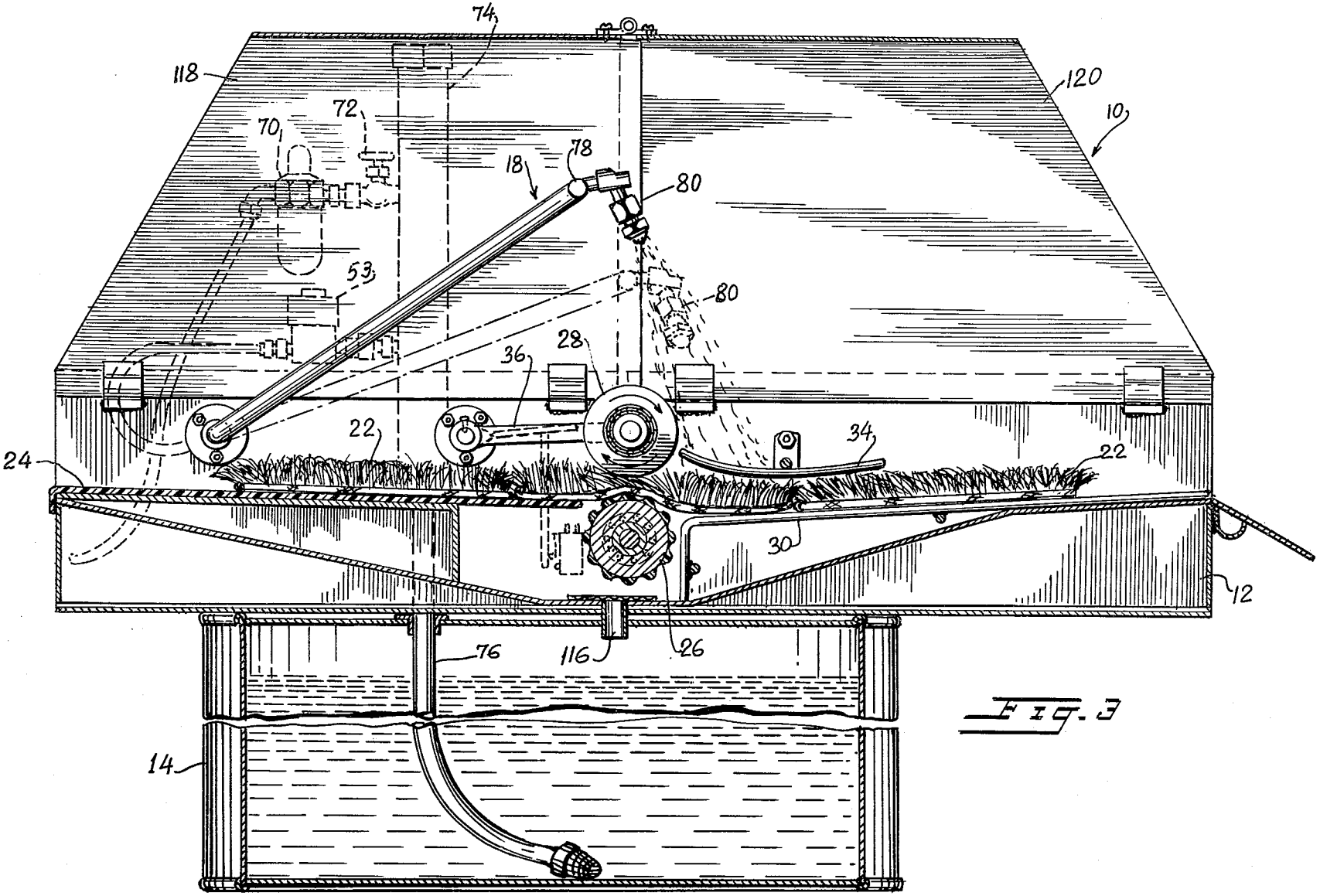
FIG. 3 is a vertical longitudional section taken on the line 3—3 of FIG. 2.
Figure 4:
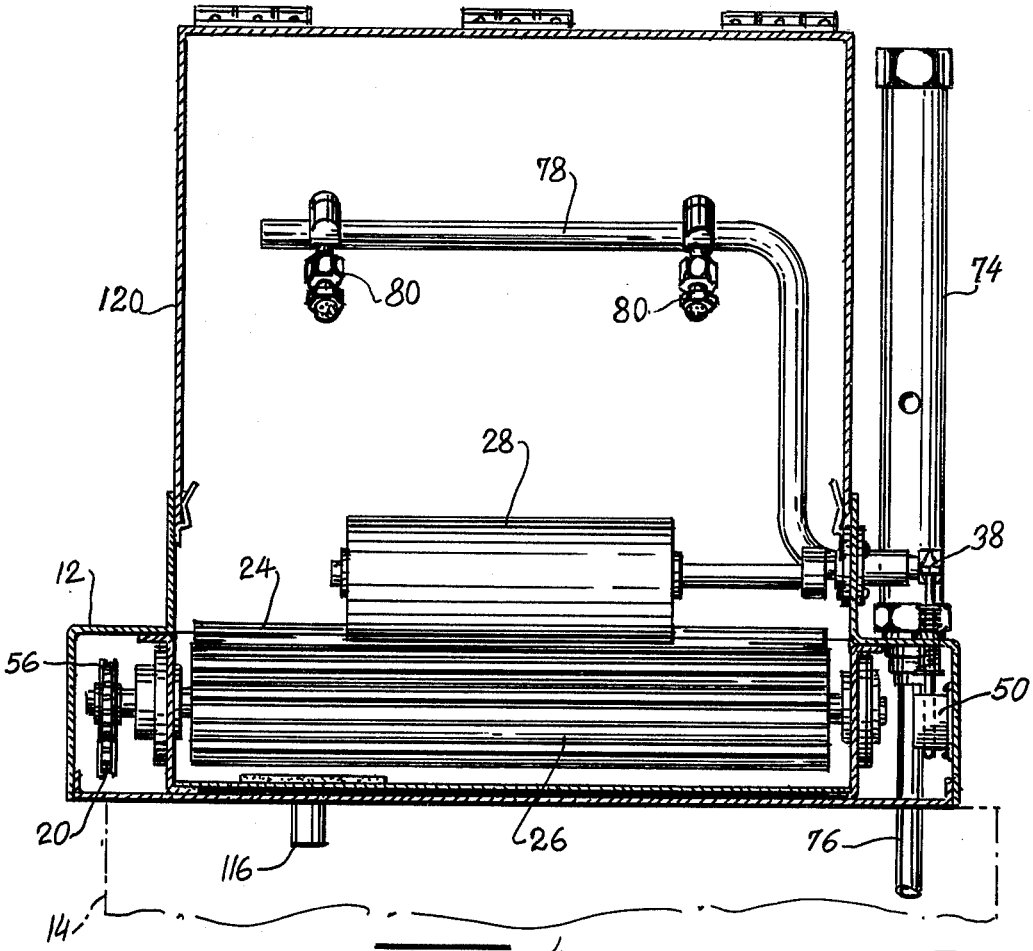
FIG. 4 is a transverse vertical section on the line 4—4 of FIG. 2.
Figure 5:
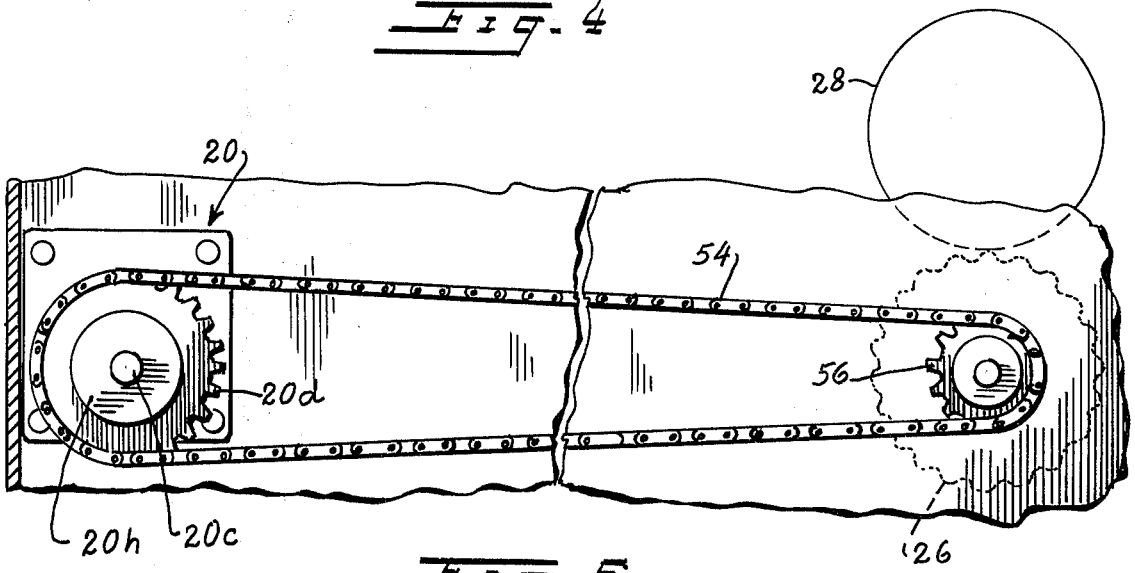
FIG. 5 is a transverse vertical section on the line 5—5 of FIG. 2 showing the chain drive mechanism.
Figure 6:
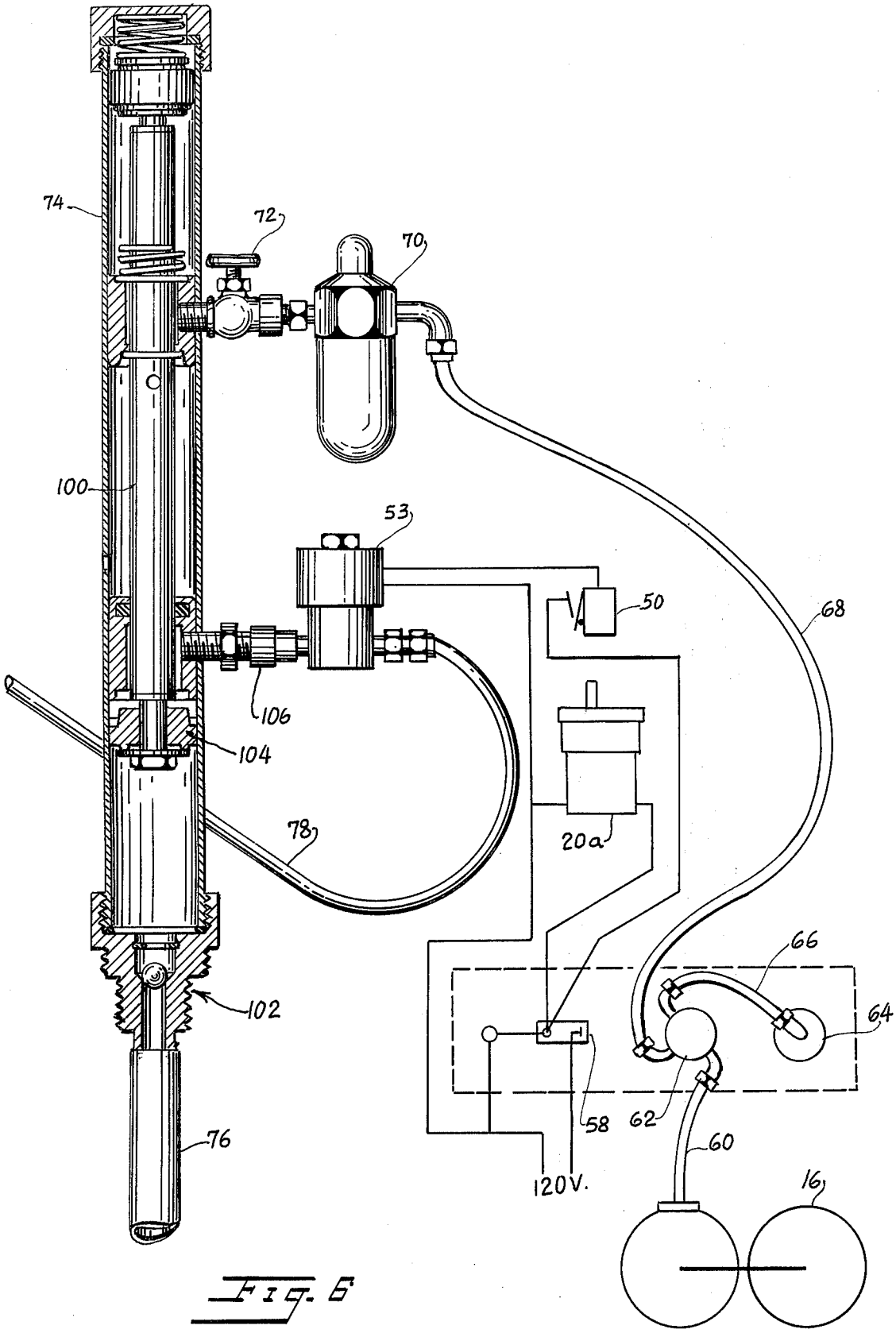
FIG. 6 is an enlarged fragmentary view, partly sectional and partly schematic, showing the compressed air system of the machine and its electrical circuit.

The mop-treating machine 10 shown in the drawing comprises a frame 12 which is adapted to be supported on a conventional 55-gallon oil drum 14 or the like, a compressed air source, such as an air compressor 16, a spray mechanism 18 which is powered by the compressed air, and a drive mechanism 20 which moves the mops 22 across the spray field. The spray mechanism removes oil or other mop-treating liquid from the drum and sprays it upon the mops as they traverse the spray field. As has above been indicated, the mops automatically actuate the spray mechanism as they pass by, and the spray automatically shuts down when the mops leave the spray station.

More specifically, mounted on frame 12 is a platform 24 on which the mops are manually placed and manually moved toward the spray station. At the discharge end of platform 24 is a pair of rollers 26 and 28 respectfully, roller 26 being a drive roller and roller 28 being an idler roller. The mops pass between the two rollers and immediately thereafter enter the spray station. At this point the mops are no longer supported either by platform 24 or by the rollers and instead they are supported by a wire grill 30 which carries them to the discharge end of the machine. Roller 26, connected to drive mechanism 20, provides the motive power which moves the mops from platform 24 to grill 30. As one mop follows the other it pushes it across the grill and off the machine into a receiving bin (not shown). To enable one mop to push the preceding mop across the grill an overhead grillwork 34 is provided. This overhead grillwork prevents the mops from sliding one over the other or piling up and preventing a free flow to the receiving bin.

Idler roller 28 is mounted on a pivotally mounted arm 36 which enables the idler roller to rise and allow the mops to pass between the two rollers. It will be observed that connected to said arm 36 is a lever arm 38 which rises and falls with the idler roller. It will be noted that the lever arm 38 is engageable with a rod 40 which is supported by a bushing 42 on frame 12 of the machine. A compression spring 44 on rod 40 bears against a head 46 on bushing 42. At its opposite end spring 44 bears against a retaining ring 48 which is secured to the rod. The function of spring 44 is to maintain the rod in contact with lever arm 38.

Adjacent the lower end of rod 40 is a solenoid switch 50 and it will be seen that the switch arm 52 is engageable with rod 40. It will shortly be seen that it is this solenoid switch which controls solenoid valve 53 and thereby controls the operation of the spray mechanism. When the switch arm 52 is depressed by rod 40, valve 53 closes and shuts off the spray mechanism; when the switch arm is released by rod 40, valve 53 opens and the spray mechanism is activated, causing a spray to be directed upon the mop or mops which pass through the spray station of the machine.

The invention is not limited to any special kind of drive mechanism for driving roller 26. A suitable drive mechanism, shown in the drawing, comprises a motor 20*a* with built-in speed-reducing gears, a friction clutch 20*b* onshaft 20*c* of the motor gear drive and a sprocket 20*d* which is also mounted on said shaft and which is driven in the said clutch. More particularly sprocket 20*d* is mounted between a friction washer 20*e* and an O-ring 20*f*, said friction washer being backed up by a collar 20*g* and said O-ring being biased against the sprocket by an adjusting collar 20*h*. A sprocket chain 54 interconnects sprocket 20*d* on motor drive shaft 20*c* with a second sprocket 56 on the shaft of drive roller 26. Switch 58 controls the circuit to drive motor 20*a* and this switch is manually actuated to control the operation of drive roller 26.

Compressor 16 may be of conventional design and no special type of compressed air source is required for the present invention. In the operation of the present invention compressed air from compressor 16 (for a compressed air tank) passes through a line 60 into a regulator 62 which controls the flow of compressed air into the machine. An air pressure gauge 64 may be provided and a line 66 connects said gauge to regulator 62. It will be understood that the regulator may be of conventional design and may be manually adjusted to adjust the pressure of the compressed air.

Air line 68 carries the regulated compressed air from regulator 62 to a lubricator 70 and thence through valve 72, to pump 74. It is this pump which forces oil or other liquid out of drum 14 through suction hose 76 and then ejects same through a manifold 78 and a plurality of spray heads or nozzles 80. It will be understood that pump 74 may be of any conventional design adapted to force a liquid out of a container and eject same under pressure through a spray head. The spray may itself be of any conventional design suited for spraying an oil or other mop-treating liquid upon a mop.

The invention is not limited to a plurality of spray heads as shown in the drawing. On the contrary, depending on the dimensions of the mop a single spray head with a sufficiently wide spray angle will be adequate for the purposes of this invention. Alternatively, should it be desired to utilize a plurality of spray heads to insure a wider field of spray this may also be done within the principles of the invention.

The particular oil pumping means which is shown in the drawing will now be described, but it should be understood that this is not a critical feature of the invention. As has been stated, pump 74 is connected through a valve 72, lubricator 70, an air line 68, a regulator 62, and another air line 60 to a motor-driven compressor 16. When valve 72 is open, compressed air will flow into plunger 100, thereby causing the plunger to move downwardly against spring action. A check valve 102 prevents any return flow of oil or other liquid from pump 74 and hose 76 back into the drum. At a predetermined point in its downward stroke plunger 100 will exhaust the charge of compressed air which it has received, while blocking a further charge of compressed air, and spring action will return the plunger to its upward position. This will cause piston 104 to apply negative pressure upon check valve 102, thereby opening said check valve and drawing oil or other liquid up into pump 74, and out through fitting 106, solenoid valve 53, pipe 77, manifold 78, and nozzles 80.

What has been described is a reciprocating type of pump which is shown in greater detail in U.S. Pat. No. 3,094,938. However, as has been stated this type of pump is not critical in the present invention and other pumps may be used with equal effect.

It will of course be understood that much of the oil or other liquid which is intended to be sprayed on the mops bypasses them, and also much of the oil or other liquid which is sprayed on the mops drips off them and it becomes necessary to provide a means of recycling what would otherwise be waste material. In this connection it will be noted that after the mops leave the two rollers they are deposited on wire grill 30. All excess oil or other liquid will pass through the wire grill and into a trough 114. This trough is located below platform 24, roller 26 and wire grill 30. A drain 116 provides communication between trough 114 and drum 14, thereby enabling the excess oil or other liquid to drain back into the drum for re-use.

It may also be desired to provide a hood enclosure for the machine to prevent spattering of oil upon the operator of the machine. This enclosure may take the form of a pair of open-ended hood sections 118 and 120 respectively which are individually hinged to the machine frame. One open end is for insertion of the untreated mops and the other is for discharge of the treated mops. Should the oil spray tend to escape through the open discharge end of the hood enclosure, a baffle arrangement such as hereinafter described may be used. Each hood section may be swung to open position to provide access to the machine.

Figure 10:
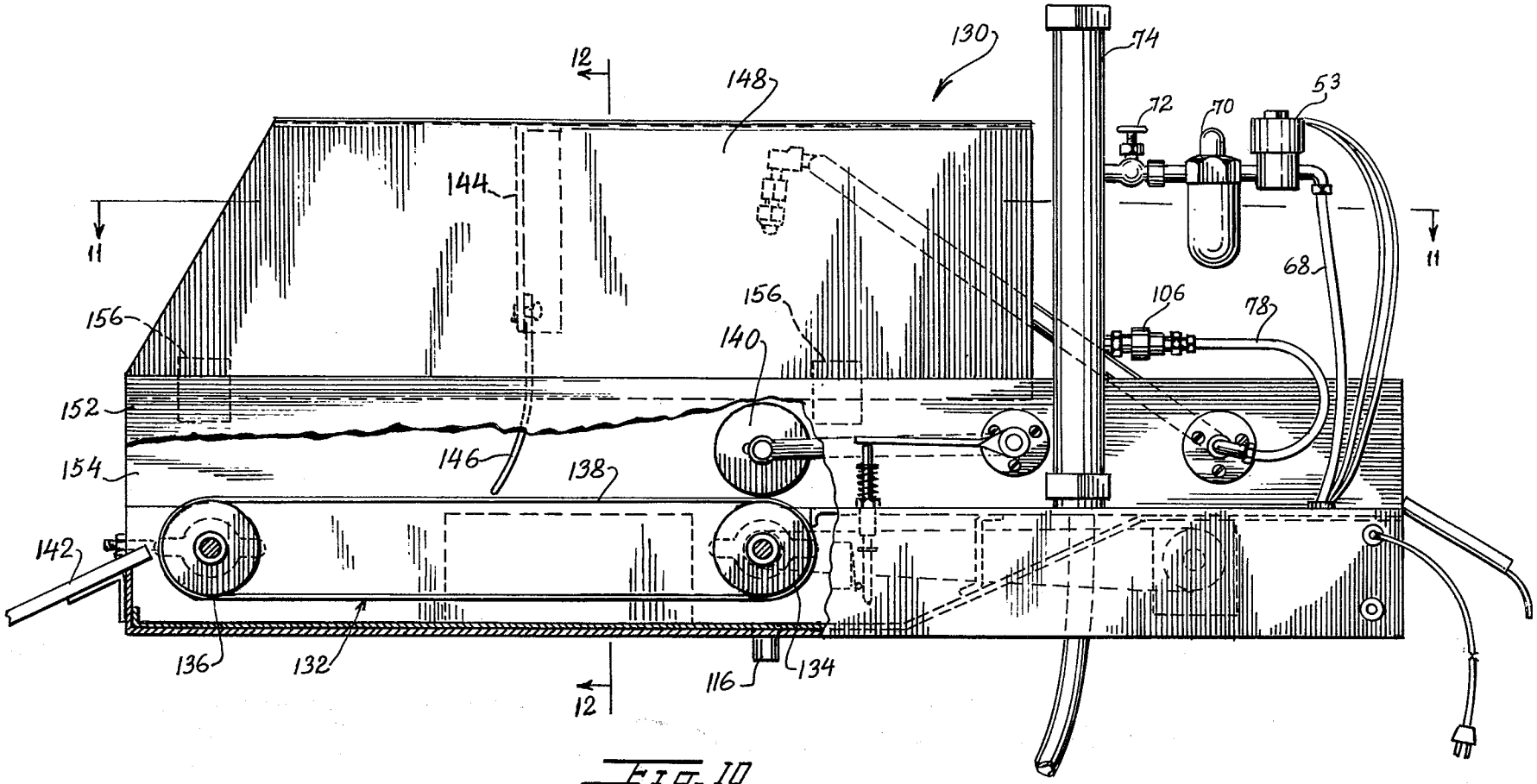
FIG. 10 is a side view, partly broken away, of a mop-treating machine made in accordance with a second form of this invention.
Figure 11:
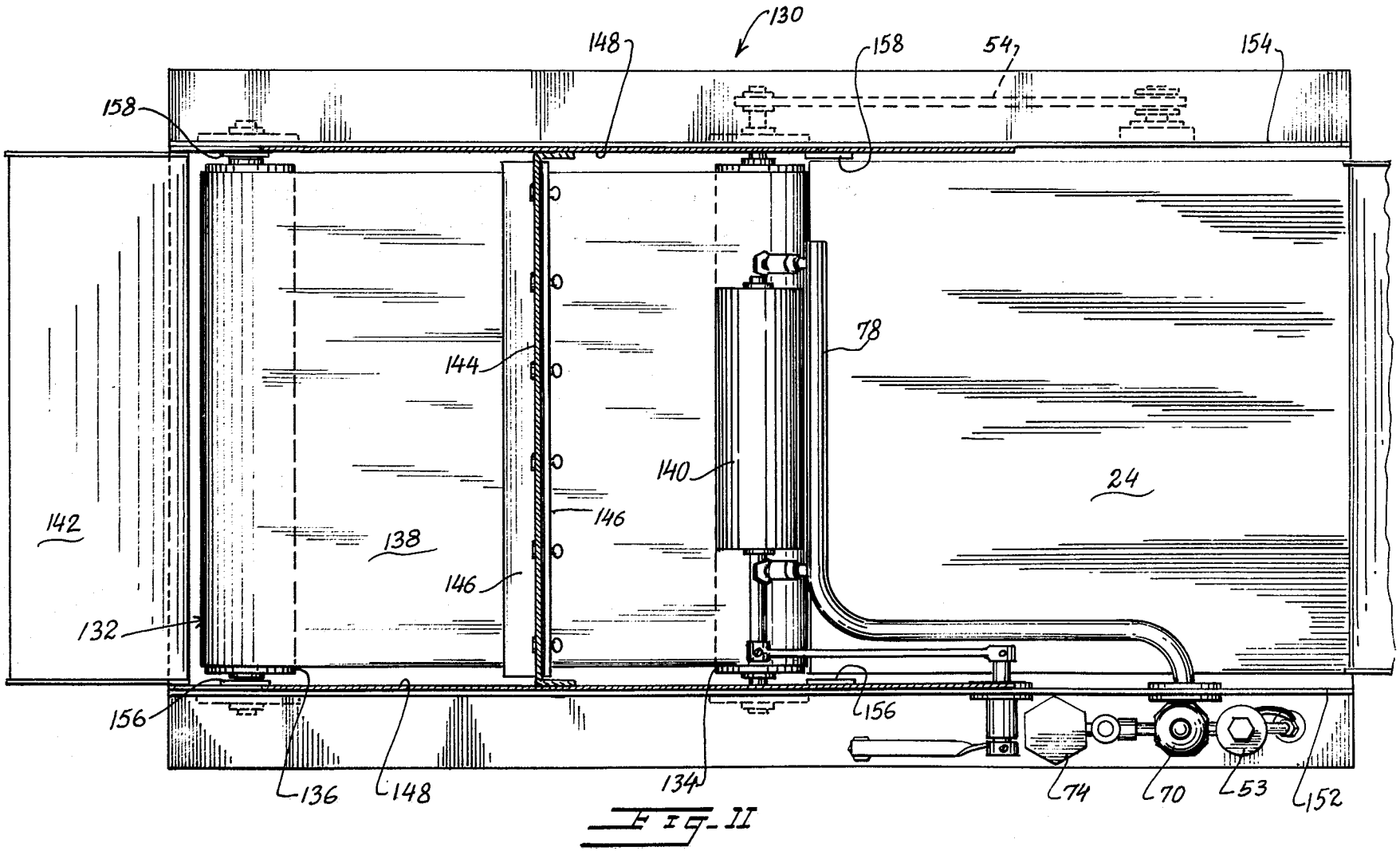
FIG. 11 is a horizontal section view on the line 11—11 of FIG. 10.
Figure 12:
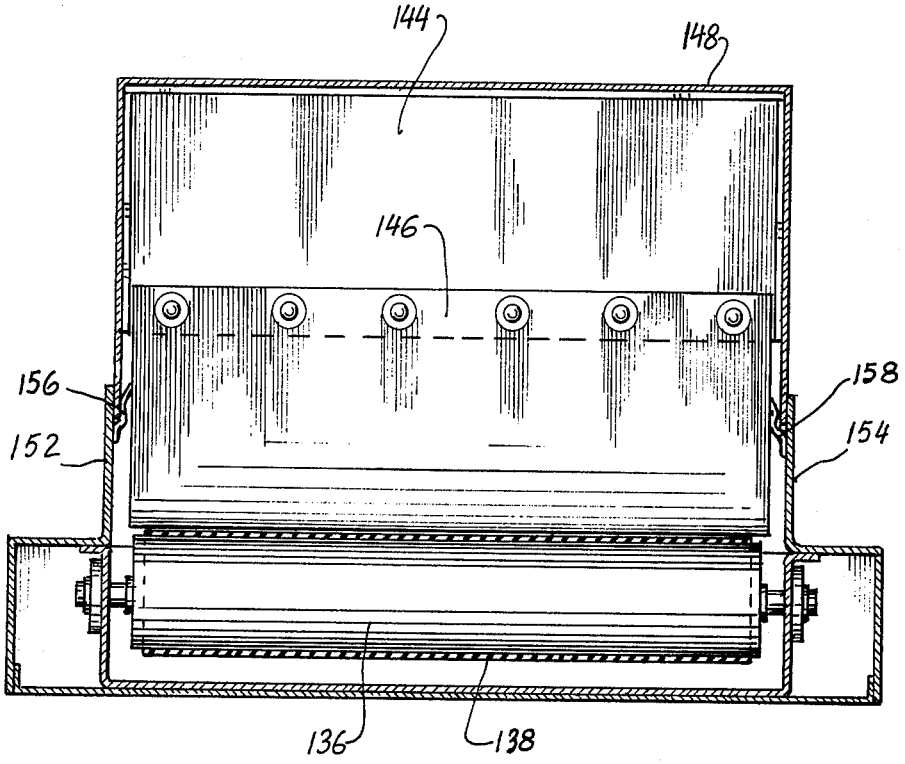
FIG. 12 is a vertical section on the line 12—12 of FIG. 10.
Figure 13:
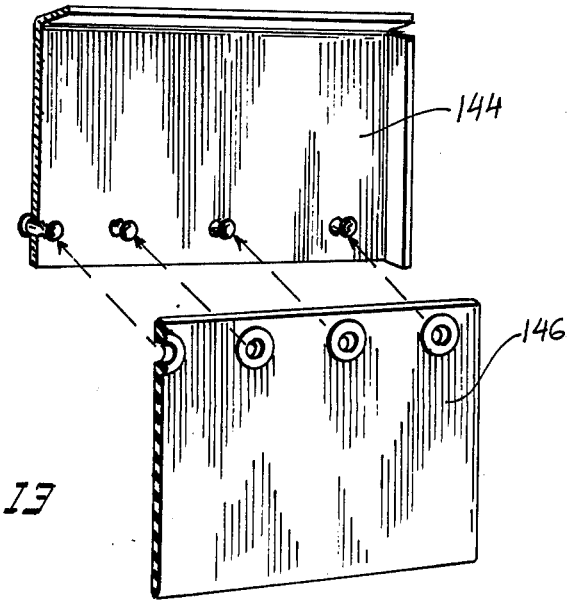
FIG. 13 is an exploded view, partly in section, showing the spray baffle arrangement.

Referring now to the second form of this invention, as shown in FIGS. 10–12 of the drawing, it will be seen that mop-treating machine 130 is essentially like mop-treating machine 10, above described, except for certain modifications which are now being set forth. In the first form of this invention, there is no positive drive which is applied to the mops after they have been treated. One mop simply pushes the other across a wire grill 30 and in that way the treated mops are discharged from the machine. In the present form of the invention, a conveyor 132 is provided in the place and stead of wire grill 30. It will be noted that conveyor 132 comprises a pair of rollers 134 and 136 respectively and a conveyor belt 138 mounted on said rollers. Roller 134 corresponds to roller 26 of the first form of the invention and is motor driven by the same means (or equivalent) that is described above. In the first form of the invention, rollers 26 and 28 are in engagement with each other in the absence of a mop between them. In the second form of the invention, conveyor belt 138 is interposed between roller 134 and roller 140.

In the operation of the machine which is now being described, a mop or series of mops is fed between roller 140 and conveyor belt 138 in the manner above set forth in respect to rollers 28 and 26. Conveyor belt 138 carries the mop or series of mops through the oil treating station and thence down a chute 142 to a collecting bin (not shown).

To prevent the oil spray from spraying oil out of the machine, a pair of baffles 144 and 146 is provided in hood 148. Baffle 144 is fixed and rigid; it is a metal plate or sheet which is secured by conventional means to the inside walls of the hood. Secured to said rigid baffle 144 is the second baffle 146 and it will be observed in FIG. 10 of the drawing that baffle 146 is a relatively flexible sheet, made for example, of sheet rubber or sheet plastics. Flexible baffle 146 hangs from rigid baffle 144 and it wipes against the conveyor belt 138 and the oil-treated mops which said conveyor belt carries. The flexible baffle may be removably secured to the rigid baffle by any conventional means as, for example, hooks and eyes or snap fasteners.

There is one additional difference between the second and first forms of the invention, and that is In the construction and mounting of the hood. In the first form of the invention, the hood consists of two section (118 and 120) which are hingedly connected to each other so that either may be swung into open or closed position independently of the other. In the second form of the invention, there is only one hood structure 148 which is held in place on the machine by means of frame members 152, 154 and clips 156, 158 mounted on said frame members. The machine may be exposed by simply removing hood 148 bodily.

The foregoing is illustrative of preferred forms of this invention and it will be understood that these preferred forms may be modified and varied within the broad scope of the appended claims.

We claim:

1. An industrial mop-treating machine, comprising:
a. a drum adapted to store mop-treating liquid,
b. said drum having an outlet and an inlet for said mop-treating liquid,
c. a frame adapted to be removably mounted on said drum of mop-treating liquid,
d. conveying means mounted on said frame for conveying a mop along said frame,
e. a trough mounted on said frame below said conveying means,
f. a drain providing communication between said trough and the inlet of said drum,
g. pump means for removing mop-treating liquid from said drum through the drum outlet,
h. spray means for spraying said removed mop-treating liquid upon said mop at a spray station, and
i. actuating means for activating said spray means when the mop enters the spray station and deactivating said spray means when the mop leaves the spray station,
j. whereby excess mop-treating liquid sprayed upon the mop drains into the trough and thence through the drain and drum inlet into the drum for removal by the pump means and for spraying by said spray means upon a subsequently conveyed mop.

2. An industrial mop-treating machine in accordance with claim 1, wherein the conveying means comprises:
a. a drive roller,
b. an idler roller, and
c. pivotal mounting means for mounting said idler roller for pivotal movement relative to said drive roller,
d. said idler roller being adopted to move away from the drive roller on said pivotal mounting in order to accomodate a mop between the two rollers.

3. An industrial mop-treating machine in accordance with claim 2, wherein the actuating means comprises:
a. a solenoid valve which controls the flow of mop-treating liquid through the spray means,
b. a switch which actuates the solenoid, and
c. connecting means between said pivotal mounting means and said switch,
d. whereby pivotal movement of said idler roller away from said drive roller to accomodate a mop between the two rollers causes the connecting means to actuate the switch and thereby to actuate the solenoid in order to open the valve which controls the spray, and
e. whereby pivotal movement of said idler roller back to the drive roller after the mop has passed between them causes the connecting means to deactivate the switch and solenoid and thereby close the valve which controls the spray.

4. An industrial mop-treating machine in accordance with claim 2, wherein the conveying means includes:
a. a conveyor belt, and
b. a second idler roller,
c. said conveyor belt being mounted on said second idler roller and on the drive roller.

5. An industrial mop-treating machine in accordance with claim 2, wherein:
a. a hood is mounted on the machine to contain the liquid spray,
b. said hood being open-ended for insertion of untreated mops into one end of the machine and discharge of treated mops from the opposite end of the machine, and c. a baffle mounted within the hood between the spray station and the discharge end of the hood to prevent escape of the spray through said discharge end, d. said baffle including a flexible skirt which extends into the exit path of the treated mops.

* * * * *